United States Patent [19]

Unruh et al.

[11] 4,175,914

[45] Nov. 27, 1979

[54] HYDRAULIC STOP

[75] Inventors: Dennis R. Unruh, Buhler; Robert J. Martin, Hutchinson, both of Kans.

[73] Assignee: The Cessna Aircraft Company, Hutchinson, Kans.

[21] Appl. No.: 802,149

[22] Filed: May 31, 1977

[51] Int. Cl.[2] ..... F04B 1/30

[52] U.S. Cl. ..... 417/218; 92/85 B

[58] Field of Search ..... 417/218, 212, 222, 270; 91/506, 409; 92/85 B

[56] References Cited

U.S. PATENT DOCUMENTS

| | | | |
|---|---|---|---|
| 2,284,897 | 6/1942 | Harrington | 417/218 |
| 2,915,985 | 12/1959 | Budzich | 417/222 |
| 3,023,739 | 6/1962 | Dickson et al. | 92/85 B |
| 3,213,760 | 10/1965 | Carr | 92/85 B |
| 3,554,093 | 1/1971 | Lonnemo | 92/13.1 |
| 3,559,538 | 2/1971 | Holder | 92/85 B |
| 3,732,041 | 5/1973 | Beal et al. | 91/506 |

*Primary Examiner*—William L. Freeh

[57] ABSTRACT

This automatic hydraulic cushioning device for cam plate positioning actuators on variable displacement, axial piston pumps eliminates the noise, vibration, and wear caused by hammering of the positioning actuator on the back plate when the actuator is close to full retraction. A supply of fluid under pressure, which is available at the back plate, is channeled to the cam plate positioning actuator. A valve in the actuator blocks off drainage of the fluid whenever the actuator is close to its fully retracted position. This retained fluid becomes a hydraulic stop and cushion for the actuator thus eliminating the hammering as well as the noise, vibration, and wear which results from the hammering.

3 Claims, 4 Drawing Figures

HYDRAULIC STOP

BACKGROUND OF THE INVENTION

The field of this invention is positioning controls for variable displacement, axial piston pumps.

U.S. Pat. Nos. 2,733,666 to Poulos, and 2,977,891 to Bishop, show use of pressurized fluids available at the back plate. In these patents the fluid is used in different ways and for different uses than the present invention discloses. In U.S. Pat. No. 2,733,666, the fluid is channeled from the back plate to the opposite end of the cylinder barrel to re-engage the barrel with the back plate when they become disengaged as described in column 1, lines 27–55. In these two patents, the back plate is called a valve plate. In U.S. Pat. No. 2,977,891, the fluid is used to act on a piston system which regulates clearance between back plate and rotor of a radial piston pump as described in column 1, lines 53–63; in the last seven lines of claim 20; and as shown in FIG. 13.

Applicants know of no prior art using pressurized fluid to serve as a hydraulic stop in a cam plate positioning actuator to prevent the actuator from hammering on the back plate. This hammering of metal on metal occurs when the actuator is close to its fully retracted position, which is when the pump is working close to full displacement. The hammering of the movable part of the actuator against the back plate causes noise, wear, and vibration but is usually of short duration, occurring just before and just after the actuator is fully retracted. While fully retracted, the movable part is forced against the back plate thus preventing hammering. The hammering is caused by the varying forces exerted on the cam plate by pump pistons. In many hydraulic systems the pump seldom reaches full displacement, and therefore the problem does not occur. There are also many systems where the hammering is of such short duration that it is not objectionable or in some cases, unnoticeable. There are systems, however, where the noise, wear, or vibration of this hammering is undesirable. It is to those systems that this invention is directed.

SUMMARY OF THE INVENTION

The principal object of this invention is to eliminate noise, vibration, and wear in a cam plate positioning actuator of a variable displacement, axial piston pump when a movable part of the actuator is close to full retraction and hammers on a back plate.

Another object of the invention is to attain the foregoing objective by minor changes in the actuator and back plate of a conventional pump using an available source of pressurized fluid.

The gist of this invention is an automatic interposing of a hydraulic stop within the cam plate positioning actuator, whenever it is close to full retraction, to prevent hammering of the actuator's movable part on the back plate whether the contacting parts be metal or non-metal. Hammering is caused by unbalanced forces of pump pistons on the cam plate causing the movable part of the actuator to pulsate and when the actuator is close to full retraction the movable part impinges upon the back plate. This invention comprises a valve to block off drainage and to retain some fluid in the actuator when it is close to full retraction. This provides the hydraulic stop and precludes the movable part from impinging upon the back plate. The retained fluid prevents any further retraction and serves as a cushion for the pulsating forces.

The valve which blocks off the drainage from the actuator comprises a portion of the movable part blocking off the drain port of the actuator when it is close to full retraction. Thus the drain port is automatically closed whenever and only when impingement of the movable part upon the back plate is about to occur. Leakage normally occurs between moving parts in pumps, thereby furnishing lubrication, and to replenish the fluid leaking from the actuator while its drain port is closed and it is acting as a hydraulic stop, a supply of fluid from a charging port is channeled to the actuator. The charging port is a relief port used in many axial piston pumps and is located in the back plate, in circular alignment with and between the pressure port and the suction port, at the point where the pump pistons are reaching the end of their pressure stroke. Its principal purpose is to reduce the bending moments on the pump drive shaft and its use in this invention is to provide a convenient source of pressurized fluid which is channeled to the actuator instead of to a sump which would be its normal destination. Other sources for the pressurized fluid can be used such as an auxiliary pump, oil from the pump pressure port or by collecting the fluid near the back plate as shown in the aforementioned U.S. Pat. No. 2,733,666, column 1, lines 27–29, and in FIGS. 2 and 3.

Variable displacement, axial piston pumps are controlled by a pressure or flow compensator or a combined pressure and flow compensator, an example of which is shown in U.S. Pat. No. 3,508,847 to Martin. The compensator, sensing the pressure and flow conditions in a circuit, adjusts displacement of the pump by either routing pressurized fluid to the cam plate positioning actuator, which decreases displacement, or by routing the fluid in the actuator to drain, which increases displacement. The actuator decreases displacement by decreasing the tilt of the cam plate which is spring-biased toward the maximum tilt position. The actuator increases displacement by increasing the tilt. The routing of the pressurized fluid to and from the compensator will be more fully described in embodiments of this invention under "Description of the Preferred Embodiments".

The hydraulic stop can be appied to various forms of actuators according to the principle of this invention by using a valve to close off the drainage of the pressurized fluid in the actuator when it is close to full retraction and replenishing the pressurized fluid in the actuator while the valve is closed.

DESCRIPTION OF THE PREFERRED EMBODIMENTS

Figure 1:
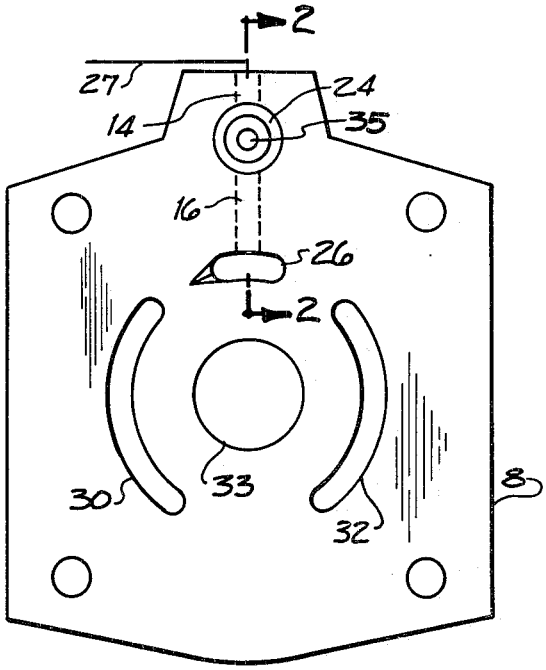
FIG. 1 is a view of the inside face of the back plate of the pump.

As can be seen in FIG. 1, the inner face of back plate 8 has a cylindrical-shaped, recessed shaft support 33, centrally located, and a series of arcuate openings 30, 26, and 32, spaced around and equidistant from the shaft support 33. These openings are a pressure port 30, located to one side of the shaft support 33; a charging port 26, located above the shaft support 33; and a suction port 32, located on a side opposite to the pressure port 30. A charging passage 16 within the back plate 8 leads upward from the charging port 26 to a circular, recessed chamber 24 in the back plate 8. A bore 35 passes through the back plate 8 and is surrounded by but separated from the chamber 24. A passage 14 within the back plate 8 extends upward from the chamber 24 and connects with a drain line 27 from a compensator illustrated schematically by block 6.

Figure 4:
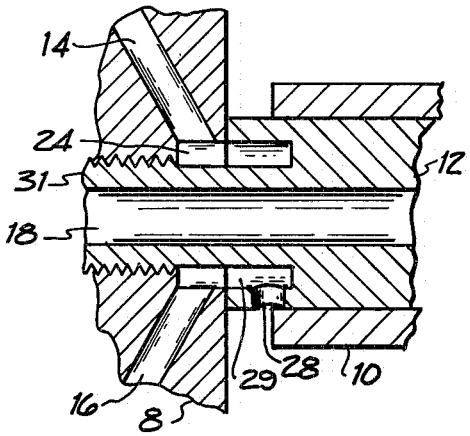
FIG. 4 is an enlarged detail of a portion of FIG. 2.
Figure 2:
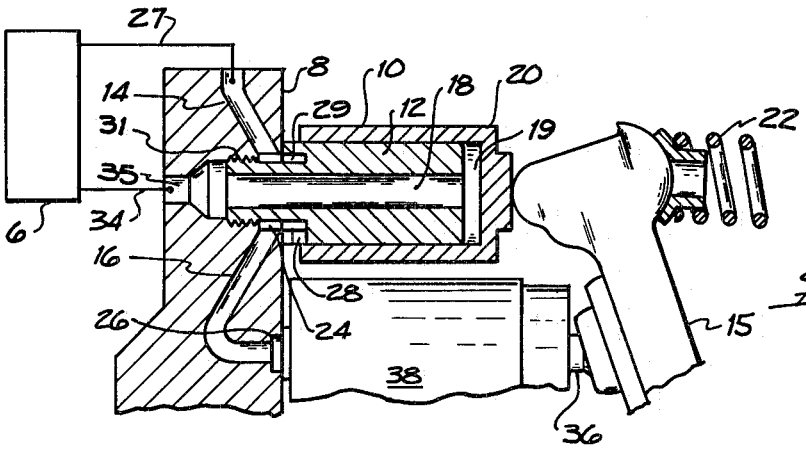
FIG. 2 is a sectional view taken on the line 2—2 of FIG. 1 through the back plate and also through an adjoining part of the pump showing an embodiment of this invention.

The hydraulic stop, in a first embodiment, can best be seen in FIG. 2 and in FIG. 4, which is an enlargement of a part of FIG. 2. The relevant parts of a conventional variable displacement, axial piston pump are shown. The back plate 8 serves as a support for a cam plate positioning actuator 20 and usually contains a compensator 6. One example of a commonly used compensator would be the pressure and flow compensator shown in U.S. Pat. No. 3,508,847 to Martin. The compensator 6 controls the cam plate positioning actuator 20 to adjust pump displacement to conditions the compensator 6 senses in the hydraulic circuit, as disclosed in detail in the above mentioned patent. Other compensators, including pressure compensators and flow compensators could also be used.

The charging passage 16 feeds pressurized fluid from the charging port 26 to the recessed chamber 24. The drain line 27 from the compensator 6 connects with the passage 14, thence with the chamber 24 and through it to the actuator 20, unlike a conventional compensator drain line which would drain to the interior of the pump case. A line 34 from the compensator 6 connects with the bore 35. A conventional cylinder block 38 rotates with its shaft, not shown, one end of which rests in the shaft support 33 shown in FIG. 1. The cylinder block 38 contains a plurality of axial pistons 36 which are reciprocated toward and away from the back plate 8 as the cylinder block 38 rotates while the pistons 36 are bearing against and engaged to a cam plate 15. A cam plate spring 22 biases the cam plate 15 toward a fully tilted position and its tilt is adjusted by the actuator 20. The actuator 20 may be in various forms, but the example shown in this embodiment comprises a closed end cylinder forming a movable part 10 sliding on a stud-shaped fixed part 12 attached to the back plate 8 by a mounting 31. The fixed part 12 has an axial bore 18 connecting the bore 35 in the back plate 8 with a chamber 19 which is enclosed by the movable part 10 and the outer end of the fixed part 12. A circular, recessed chamber 29 is located in the mounting end of the fixed part 12 and the chamber 29 adjoins and is freely connected with the circular, recessed chamber 24 in the back plate 8. A drain port 28 connects the chamber 29 with the inside of the pump case which serves as the sump. The drain port 28 is located in the sidewall of the fixed part 12 at a point where it will be covered and closed off by the movable part 10 whenever and only when the movable part 10 is close to the back plate 8. This condition occurs when the actuator 20 is close to being fully retracted which is the maximum displacement position of cam plate 15.

As used in this application, the words "close to being fully retracted", "close to full retraction", etc. mean that the movable part 10 of the actuator 20 is 2 to 5 millimeters or more from the back plate 8 and the fixed part 12 when the closing off of the drain port 28 occurs. The clearance of 2 to 5 millimeters is sufficient to prevent metal to metal contact of the movable part 10 due to pulsations in the actuator caused by reciprocating forces of the pistons 36 but it may be desirable to use a larger clearance for other reasons, such as limiting the displacement. In other designs of actuators, other arrangements of parts are used and it will be obvious where the clearance is needed between movable and fixed parts to implement the principle of providing the hydraulic stop by confining fluid within the actuator by closing off drainage and replenishing fluid when the actuator is close to full retraction.

In operation, when the compensator 6 senses that the circuit requires a greater supply of fluid, fluid is permitted to flow from the line 34 through line 27 to drain. This starts emptying chamber 19, under the influence of the spring 22. The fluid flows out through the bore 18, thence through the bore 35, line 34, compensator 6, line 27, passage 14, chamber 24, chamber 29, and out through the drain port 28 until the needs of the circuit are met. When the actuator 20 reaches a point close to full retraction, the movable part 10 slides over and closes off the drain port 28 and the remaining fluid is locked in the chamber 19 thereby stopping any further movement of actuator 20. This prevents the movable part 10 from striking the back plate 8, or the outer end of the fixed part 12, whichever is closer. The passage 16 conducts a supply of pressurized fluid from the charging port 26 to the chamber 24 where it replenishes fluid lost through normal leakage and thus keeps sufficient fluid in the chamber 19, while drain port 28 is closed, to keep the movable part 10 from striking the back plate 8 or other fixed parts, if closer.

Figure 3:
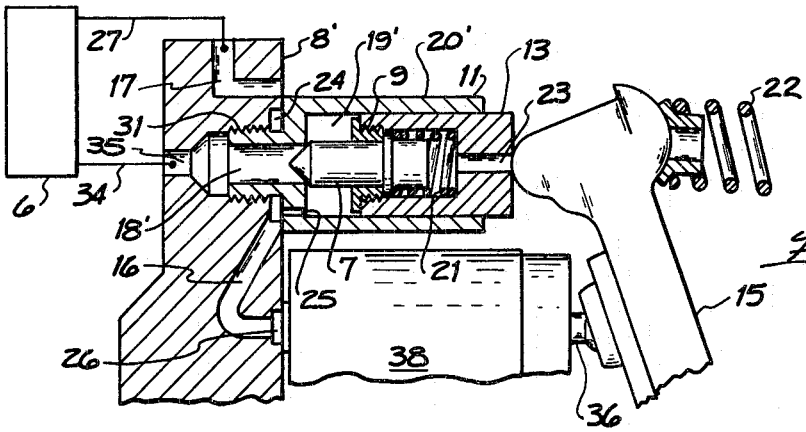
FIG. 3 is a sectional view similar to FIG. 2 but of another embodiment.

Referring now to FIG. 3, a second embodiment of the hydraulic stop is shown with a different valving means for closing off the drainage of an actuator 20′ and a different routing of the pressurized fluid to replenish the actuator 20′ while the valving is closed. The relevant parts of the conventional variable displacement, axial piston pump are again shown in FIG. 3. A back plate 8′ serves as a support for the cam plate positioning actuator 20′ and usually contains the compensator 6 similar to that shown in FIG. 2. Compensator 6 controls the cam plate positioning actuator 20′ to adjust pump displacement to conditions the compensator 6 senses in the hydraulic circuit.

The charging passage 16 feeds pressurized fluid from the charging port 26 to the recessed chamber 24. The drain line 27 from the compensator 6 connects, in a conventional manner, with a passage 17 and thence to the interior of the pump case which is the sump. The line 34 from the compensator 6 connects with the bore 35. The conventional cylinder block 38 rotates with its shaft, not shown, one end of which rests in a shaft support, not shown, in the back plate 8′ but which is like the shaft support 33 shown in FIG. 1. The cylinder block 38 contains a plurality of axial pistons 36 which are reciprocated toward and away from the back plate 8′ as the cylinder block 38 rotates due to the positioning of cam plate 15. The cam plate spring 22 biases the cam plate 15 toward the fully tilted position and its tilt is adjusted by the actuator 20′. The actuator 20′ may be in various forms, but the example shown in this embodiment comprises a movable part 13 sliding within a closed end cylinder forming a fixed part 11, the closed end of which is attached to the back plate 8′ by the mounting 31. The mounting 31 and adjacent closed end of the fixed part 11 has an axial bore 18' connecting the bore 35 with a chamber 19'. A check pin 7 is located in the inner end of the movable part 13. Pin 7, which is somewhat larger diameter than the axial bore 18', is biased toward the near end of the axial bore 18' by a check pin spring 21 and held in the movable part 13 by a bushing 9. A drain 23 in the movable part 13 drains the spring cavity within the movable part 13. A small diameter passage 25 connects recessed chamber 24 with the chamber 19'. The valving in this embodiment comprises the check pin 7 closing the end of the passage 18' whenever and only when the movable part 13 is close to the fully retracted end of its stroke.

In operation, when the compensator 6 senses that the circuit requires a greater supply of fluid, the fluid is permitted to drain from the line 34 through line 27 to the pump case, until the needs of the circuit are met or until the actuator 20' reaches the point close to full retraction. At that point the movable part 13, under the influence of the spring 22 moves the check pin 7 against the open end of the bore 18' and closes off the flow or fluid out of the chamber 19'. The fluid remaining in the chamber 19' stops the further retraction of the actuator 20' and serves as the hydraulic stop, preventing the movable part 13 from striking the closed end of the fixed part 11. Sufficient pressurized fluid from the charging port 26 flows through the passage 16 to the recessed chamber 24 and thence through the passage 25 to replenish the fluid lost from the chamber 19' due to normal leakage. Sufficient fluid is thus kept in the chamber 19' while the check pin 7 is closing off the opening to axial bore 18' to form the hydraulic stop and keep the movable part 13 from striking the closed end of the fixed part 11. Excess oil in chamber 19', supplied by charging port 26, positions movable member 13 against spring 22 until check pin 7 is unseated sufficiently to allow excess to exit through bore 18'. The hydraulic stop may be adjusted to points of less retraction by adjustment of the position where the check pin 7 closes off the flow through the bore 18'.

Having described the invention with sufficient clarity to enable those familiar with the art to construct and use it, we claim:

1. A hydraulic stop for a cam plate positioning actuator of a variable displacement axial piston pump comprising:

a back plate having a set of pump ports including a charging port;

a stationary portion of the actuator mounted to the back plate;

a slidable portion of the actuator mounted on the stationary portion and fully retracted when the cam plate is in its maximum displacement position;

a chamber in the back plate adjacent to the stationary portion of the actuator;

a charging passage through the back plate connecting the charging port with the chamber in the back plate;

a spring which biases the slidable portion of the actuator toward its fully retracted position;

a chamber within the actuator for the pressurized fluid which operates the actuator;

a pressure and flow compensator operatively connected to the actuator;

a drain line from the compensator to the chamber in the back plate; and means for valving the drain port by the slidable portion of the actuator sliding over and blocking the drain port when the actuator is close to its fully retracted position which blocking causes the pressurized fluid to flow from the chamber in the back plate through the drain line from the compensator, reversing its draining direction, to the compensator and thence to the positioning actuator chamber providing the hydraulic stop so that the slidable portion of the actuator does not make metal to metal contact with the back plate.

2. A hydraulic stop for a cam plate positioning actuator of a variable displacement axial piston pump, comprising:

a back plate having a set of pump ports including a charging port;

a stationary portion of the actuator mounted to the back plate;

a slidable portion of the actuator mounted on the stationary portion and fully retracted when the cam plate is close to its maximum displacement position;

a chamber in the back plate adjacent to the stationary portion of the actuator;

a spring which biases the actuator toward full retraction;

a chamber within the actuator for the pressurized fluid which operates the actuator;

a pressure and flow compensator operatively connected to the chamber within the actuator;

a drain line from the compensator to a sump;

a check pin, spring mounted on the slidable portion of the actuator, located so as to block the connection between the compensator and the chamber within the actuator when the actuator is close to being fully retracted; and a passage permitting limited flow between the chamber in the back plate and the chamber within the actuator so that when the check pin blocks the connection between the compensator and the chamber within the actuator stopping further draining of the chamber, the passage permits a limited flow to the chamber to maintain pressure providing the hydraulic stop so that the slidable portion of the actuator does not make metal to metal contact with the back plate.

3. A hydraulic stop for a swash plate positioning actuator at maximum pump displacement on an axial piston pump comprising:

a positioning actuator including a first movable element in contact with the swash plate for actuating same and a second fixed element relatively movable with respect to the first element;

means for supplying constant pressurized fluid to the positioning actuator; and means for valving located between the movable and fixed elements of the positioning actuator having a first position normally draining the actuator of the pressurized fluid at all actuator positions except close to its fully retracted position and a second position blocking said drain flow between the movable and fixed elements whereby the fluid is trapped within the positioning actuator.

* * * * *